US010926156B2

(12) United States Patent
Ito

(10) Patent No.: US 10,926,156 B2
(45) Date of Patent: Feb. 23, 2021

(54) CATCHING TOOL FOR BASEBALL

(71) Applicant: Mizuno Corporation, Osaka (JP)

(72) Inventor: Norifumi Ito, Hyogo (JP)

(73) Assignee: Mizuno Corporation, Osaka (JP)

( * ) Notice: Subject to any disclaimer, the term of this patent is extended or adjusted under 35 U.S.C. 154(b) by 25 days.

(21) Appl. No.: 15/780,825

(22) PCT Filed: Dec. 2, 2016

(86) PCT No.: PCT/JP2016/085888
§ 371 (c)(1),
(2) Date: Jun. 1, 2018

(87) PCT Pub. No.: WO2017/094881
PCT Pub. Date: Jun. 8, 2017

(65) Prior Publication Data

US 2018/0345118 A1 Dec. 6, 2018

(30) Foreign Application Priority Data

Dec. 3, 2015 (JP) ..... JP2015-236401

(51) Int. Cl.
*A63B 71/14* (2006.01)

(52) U.S. Cl.
CPC ..... *A63B 71/143* (2013.01); *A63B 71/14* (2013.01)

(58) Field of Classification Search
CPC ..... A63B 71/143; A63B 71/14; A63B 71/141; A63B 2069/0011; A41D 13/081; A41D 13/087; A41D 19/01523; A41D 19/0006
(Continued)

(56) References Cited

U.S. PATENT DOCUMENTS 2,231,204 A * 2/1941 Turner ..... A63B 71/143 2/19
3,169,250 A * 2/1965 Heiman ..... A63B 71/143 2/19

(Continued)

FOREIGN PATENT DOCUMENTS

JP 03039078 4/1991
JP 05000182 1/1993

(Continued)

OTHER PUBLICATIONS

Japanese Office Action dated Nov. 4, 2020 issued in related Japanese Application No. 2017-554199.

(Continued)

*Primary Examiner* — Amy Vanatta
(74) *Attorney, Agent, or Firm* — Troutman Pepper Hamilton Sanders LLP; James E. Schutz; Micah B. Hensley

(57) ABSTRACT

A catching tool for baseball according to the present invention includes an inner stall including an inner finger stall having a distal portion and a proximal portion, and an outer stall including an outer finger stall. The outer finger stall includes a projecting bonding portion projecting inwardly. The inner finger stall includes a lateral piece having a cutout formed from the proximal portion side toward the distal portion, and a back piece bonded to the lateral piece so as to cover the cutout. The inner finger stall has a step formed by the lateral piece and the back piece at a position facing the projecting bonding portion, and the step is engageable with the projecting bonding portion.

8 Claims, 6 Drawing Sheets

(58) Field of Classification Search
USPC ..... 2/19, 163
See application file for complete search history.

(56) References Cited

U.S. PATENT DOCUMENTS

| | | | | |
|---|---|---|---|---|
| 3,528,107 | A * | 9/1970 | Rosenbaum | A63B 71/143 2/19 |
| 3,576,036 | A | 4/1971 | Latina | |
| 4,192,018 | A * | 3/1980 | Latina | A63B 71/143 2/19 |
| 4,477,927 | A * | 10/1984 | Tsubota | A63B 71/143 2/19 |
| 6,553,571 | B1 | 4/2003 | Guenther et al. | |
| 6,634,029 | B1 * | 10/2003 | Sullivano | A63B 71/143 2/19 |
| 7,111,326 | B1 * | 9/2006 | Sullivano | A63B 71/14 2/159 |
| 2005/0120453 | A1 * | 6/2005 | Wu | A63B 71/143 2/19 |
| 2006/0272068 | A1 * | 12/2006 | Motooka | A41D 19/01523 2/19 |
| 2007/0044194 | A1 * | 3/2007 | Motooka | A63B 71/143 2/19 |

FOREIGN PATENT DOCUMENTS

| | | |
|---|---|---|
| JP | 06023317 | 6/1994 |
| JP | H08215368 A | 8/1996 |
| JP | H09201442 A | 8/1997 |
| JP | 2004236731 A | 8/2004 |
| JP | 2009131621 A | 6/2009 |

OTHER PUBLICATIONS

International Search Report issued in related International Application No. PCT/JP2016/085888 dated Feb. 14, 2017.

* cited by examiner

CATCHING TOOL FOR BASEBALL

CROSS REFERENCE TO RELATED PATENT APPLICATION

This application is a U.S. National Stage of International Patent Application No. PCT/JP2016/085888, filed 2 Dec. 2016, which claims the benefit of Priority to Japanese Application No. 2015-236401, filed 3 Dec. 2015. The entire contents of which are hereby incorporated in their entireties by reference herein.

TECHNICAL FIELD

The present invention relates to a catching tool for baseball, and particularly to a baseball glove.

BACKGROUND ART

Conventional baseball gloves have a configuration in which an inner stall with inner finger stalls is inserted into an outer stall with outer finger stalls. The outer finger stall is generally formed of a plurality of leather members layered on and sewn to each other. The portion of the outer finger stall, in which the plurality of leather members are sewn together, is accordingly a bulge projecting inwardly of the outer finger stall.

The inner stall with the inner finger stalls generally includes a surface member including a palm portion and finger portions extending from the palm portion. Also, a back member is bonded to the front member so as to cover the back surface of the finger portion. Such a back member may be formed of a plurality of members sewn together (for example, see Japanese Utility Model Publication No. 06-23317 (PTD 1)). In the baseball glove described in PTD 1, the back member of the inner finger stall of the inner stall is formed of a back piece and lateral pieces sewn to opposite sides of the back piece.

CITATION LIST

Patent Document

PTD 1: Japanese Utility Model Publication No. 06-23317

SUMMARY OF INVENTION

Technical Problem

In the formation of the back member of the inner finger stall using one member, the back member needs to be curved greatly. This leads to the formation of a portion with an increased height in the inner finger stall. Consequently, a bulge of the outer finger stall which projects inwardly presses the back member of the inner finger stall.

Additionally, the inner finger stall is not secured to the outer finger stall in the conventional baseball glove. This causes a relative positional shift between the inner finger stall and the outer finger stall during the use of the baseball glove. Thus, the shape of the inner finger stall is not stable due to the effect caused by the bulge of the outer finger stall, which projects inwardly, pressing the back member of the inner finger stall. For example, the inner finger stall is tilted laterally in the outer finger stall, or the inner finger stall deforms. For the conventional baseball glove, the user may accordingly have difficulty in slipping the fingers into the inner finger stalls.

In the conventional baseball glove, further, the bulge located on the inner side of the outer finger stall presses the back member of the inner finger stall. This allows the bulge to press the finger of the user of the baseball glove via the back member of the inner finger stall. Such pressing may cause discomfort or pain to the user during the use of the baseball glove.

In the baseball glove described in PTD 1, the back member of the inner finger stall is formed of a back piece and lateral pieces. The baseball glove described in PTD 1 can thus solve the problem of the formation of a portion with an increased height in the inner finger stall. The baseball glove described in PTD 1, however, has no measures taken to secure the inner finger stall to the outer finger stall. The baseball glove described in PTD 1 accordingly cannot solve another problem; the user has difficulty in slipping the fingers into the inner finger stalls. In addition, as to the problem of the discomfort or pain felt by the user due to the bulge located on the inner side of the outer finger stall, no measures are taken in the baseball glove described in PTD 1.

The present invention has been made in view of such problems of the conventional technology. Specifically, the present invention has an object to provide a catching tool for baseball that allows the user of the catching tool for baseball to slip the fingers thereinto easily and causes no discomfort or pain to the user during its use.

Solution to Problem

A catching tool for baseball according to the present invention includes an inner stall including an inner finger stall having a distal portion and a proximal portion, and an outer stall including an outer finger stall. The outer finger stall includes a projecting bonding portion projecting inwardly. The inner finger stall includes a lateral piece having a cutout formed from the proximal portion side toward the distal portion, and a back piece bonded to the lateral piece so as to cover the cutout. The inner finger stall has a step formed by the lateral piece and the back piece at a position facing the projecting bonding portion. The step is engageable with the projecting bonding portion.

In the catching tool for baseball according to the present invention, the step formed by the lateral piece and the back piece faces the projecting bonding portion located on the inner side of the outer finger stall, causing the projecting bonding portion of the outer finger stall which projects inwardly and the step to be engaged with each other. The projecting bonding portion accordingly does not deform the inner finger stall excessively. Thus, the catching tool for baseball according to the present invention is less likely to cause discomfort or pain to the user. In the catching tool for baseball according to the present invention, since the step formed by the lateral piece and the back piece in the inner finger stall is engaged with the projecting bonding portion, the positions of the inner finger stall and the outer finger stall are less likely to change with respect to each other. This can prevent or reduce a lateral collapse of the inner finger stall in the outer finger stall.

Advantageous Effects of Invention

The present invention provides a catching tool for baseball that allows the user to slip the fingers thereinto easily and causes no discomfort or pain during its use.

DESCRIPTION OF EMBODIMENTS

Embodiment 1

Figure 1:
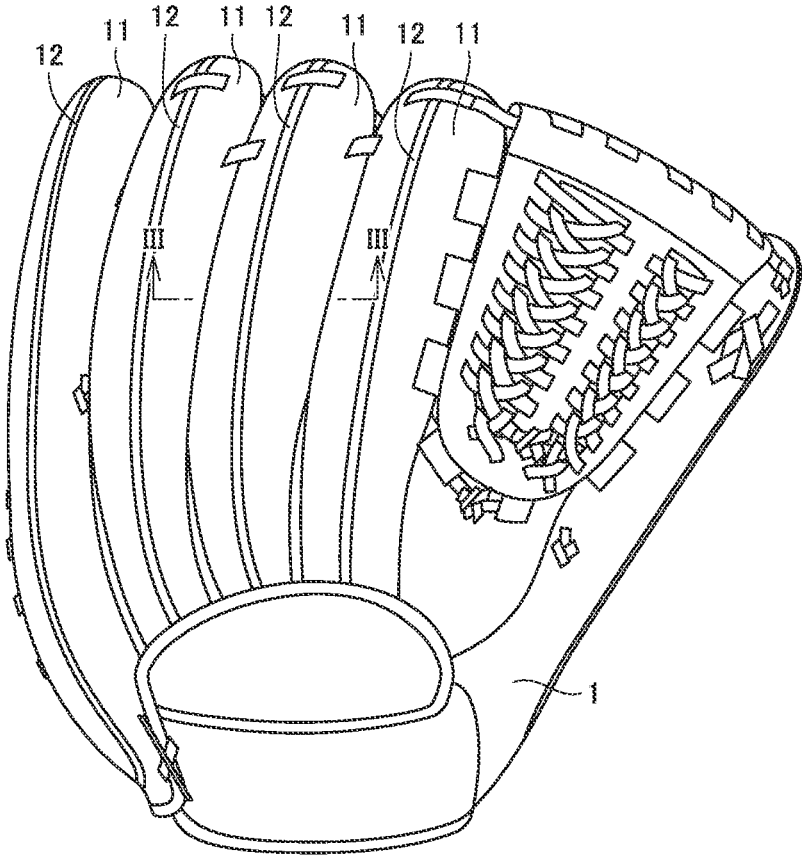
FIG. 1 shows an appearance of a baseball glove according to Embodiment 1.

Embodiment 1 will now be described with reference to the drawings. The same or corresponding portions will be denoted by the same reference signs in the drawings. At least some parts of the embodiments described below may be combined as appropriate.

Overall Structure of Baseball Glove According to Embodiment 1

Figure 2:
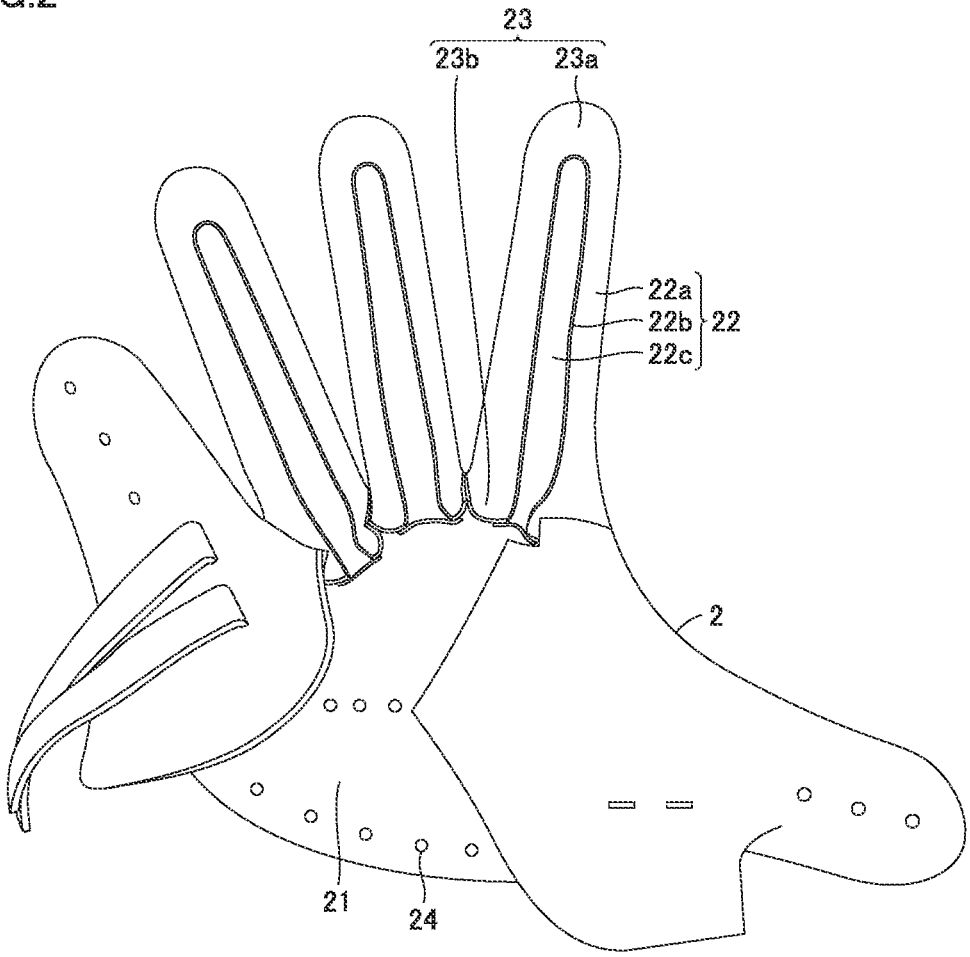
FIG. 2 shows an appearance of an inner stall of the baseball glove according to Embodiment 1.

First, the overall structure of a baseball glove according to Embodiment 1 will be described. FIG. 1 shows an appearance of the baseball glove according to Embodiment 1. FIG. 2 shows an appearance of an inner stall of the baseball glove according to Embodiment 1.

As shown in FIGS. 1 and 2, the baseball glove according to Embodiment 1 includes an outer stall 1 and an inner stall 2. Outer stall 1 is preferably made of leather material. The leather material may be, for example, natural leather or synthetic leather. Outer stall through-holes (not shown) are formed in the catch surface of outer stall 1.

As shown in FIG. 1, outer stall 1 includes outer finger stalls 11. Outer finger stalls 11 are provided at the positions corresponding to the thumb, index finger, middle finger, ring finger, and little finger of the user. Each outer finger stall 11 is formed of a plurality of leather materials bonded together. A projecting bonding portion 12 is formed at the portion at which the plurality of leather materials are bonded together. Projecting bonding portion 12 is preferably formed by layering a plurality of leather members on each other with a spacer therebetween and bonding the layers to each other by, for example, sewing. In Embodiment 1, projecting bonding portion 12 formed on the finger nail side of outer finger stall 11 is located at one location close to the center of outer finger stall 11.

As shown in FIG. 2, inner stall 2 includes a front member 21 and a back member 22. Front member 21 includes a palm portion 21*a* and finger portions 21*b* extending from the palm portion. Front member 21 has inner stall through-holes 24. Back member 22 is bonded to finger portion 21*b* of front member 21 by a method such as sewing. Thus, an inner finger stall 23 is formed. Inner finger stall 23 has a distal portion 23*a* and a proximal portion 23*b*. Back member 22 includes a lateral piece 22*a* having a cutout 22*b*, and a back piece 22*c* bonded to lateral piece 22*a* by, for example, sewing so as to cover cutout 22*b*.

Every inner finger stall 23 does not need to be formed of lateral piece 22*a* and back piece 22*c*. For example, each of inner finger stalls 23 corresponding to the index finger, middle finger, and ring finger may be formed of lateral piece 22*a* and back piece 22*c*, and each of inner finger stalls 23 corresponding to the thumb and little finger may be formed of one back member.

As shown in FIG. 2, cutout 22*b* is formed from proximal portion 23*b* side of inner finger stall 23 toward distal portion 23*a*. Cutout 22*b* may be provided up to the vicinity of distal portion 23*a* of inner finger stall 23. Alternatively, cutout 22*b* may be provided up to a position with a distance of 50 mm from proximal portion 23*b* of inner finger stall 23. Still alternatively, cutout 22*b* may be provided up to a position with a distance of 10 mm from proximal portion 23*b* of inner finger stall 23.

In the baseball glove according to Embodiment 1, back piece 22*c* is bonded to the inner side 5 of lateral piece 22*a*. Consequently, a step 22*d* (see FIG. 3) that is recessed inwardly of inner finger stall 23 is formed between lateral piece 22*a* and back piece 22*c*.

Front member 21 and back member 22 are preferably made of leather material. Leather material may be, for example, natural leather or synthetic leather. Lateral piece 22*a* and back piece 22*c* are preferably made of different materials. Further, the material for back piece 22*c* is preferably softer than the material for lateral piece 22*a*. The softness of lateral piece 22*a* and the softness of back piece 22*c* are measured in accordance with the method described in ISO-17235. Additionally, back piece 22*c* preferably has a thickness smaller than the thickness of lateral piece 22*a*.

Inner stall 2 is inserted into outer stall 1 by inserting inner finger stalls 23 into outer finger stalls 11. With inner stall 2 inserted into outer stall 1, a string-shaped member is caused to pass through inner stall through-holes 24 and outer stall through-holes and is subsequently tied, so that inner stall 2 is secured to outer stall 1.

Structure of Finger Stall of Baseball Glove According to Embodiment 1

Figure 3:
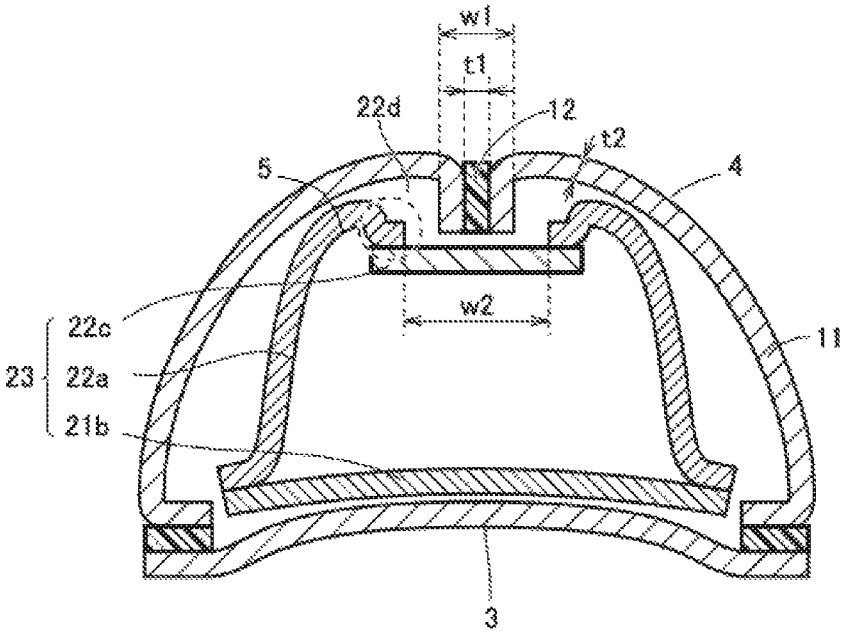
FIG. 3 is a sectional view of a finger stall portion of the baseball glove according to Embodiment 1.

Next, the detailed structure of the finger stall of the baseball glove according to Embodiment 1 will be described. FIG. 3 is a sectional view of a finger stall portion of the baseball glove according to Embodiment 1. As shown in FIG. 3, projecting bonding portion 12 projects inwardly of outer finger stall 11.

As shown in FIG. 3, the baseball glove has a catching side 3 opposite a finger nail side 4. Inner finger stall 23 includes lateral piece 22*a*, back piece 22*c*, and finger portion 21*b*. Step 22*d* is formed at the bonding portion at which lateral piece 22*a* and back piece 22*c* are bonded to each other. Step 22*d* is arranged at a position facing projecting bonding portion 12. Step 22*d* is recessed inwardly of inner finger stall 23. Step 22*d* is thus engageable with projecting bonding portion 12. Examples of the case in which step 22*d* is engageable with projecting bonding portion 12 include the case in which a space is defined between step 22*d* and projecting bonding portion 12 as shown in FIG. 3, as well as the case in which step 22*d* and projecting bonding portion 12 are in intimate contact with and are fitted to each other.

A thickness t1 of an intermediate member caught in the leather member of outer finger stall 11 in projecting bonding portion 12 may be, for example, 1.2 mm or more and 2.5 mm or less. The lower limit of thickness t1 may be 1.6 mm. The upper limit of thickness t1 may be 2.1 mm. A thickness t2 of the leather member of outer finger stall 11 may be 1.2 mm or more and 2.3 mm or less. The lower limit of thickness t2 may be 1.6 mm. The upper limit of thickness t2 may be 1.9 mm.

A width W1 of projecting bonding portion 12 may be, for example, 3.6 mm or more and 7.1 mm or less. The lower limit of width W1 may be 4.8 mm. The upper limit of width W1 may be 5.9 mm. In back piece 22*c* in FIG. 3, bonding portions to be bonded with lateral piece 22*a* are formed at opposite ends. Steps 22*d* are thus formed at opposite ends of back piece 22*c*. In the direction perpendicular to the direction in which outer finger stall 11 extends, an engagement width W2 that is the distance between steps 22*d* located at the opposite ends of back piece 22*c* may be, for example, 3.5 mm or more and 7.2 mm or less. The lower limit of engagement width W2 may be 3.6 mm, 4.7 mm, or 4.8 mm. The upper limit of engagement width W2 may be 7.1 mm, 6.0 mm, or 5.9 mm. Engagement width W2 may be substantially equal to width W1 of projecting bonding portion 12 or may be greater than width W1.

Effects of Baseball Glove According to Embodiment 1

The effects of the baseball glove according to Embodiment 1 will be described below by comparison with the comparative example.

Figure 4:
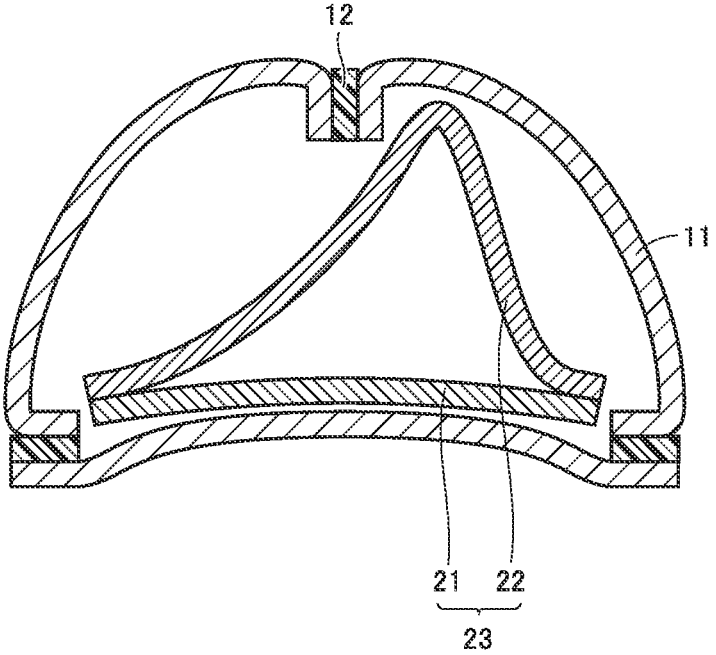
FIG. 4 is a sectional view of a finger stall portion of a baseball glove according to a comparative example.

Similarly to the baseball glove according to Embodiment 1, a baseball glove according to the comparative example includes outer stall 1 having outer finger stalls 11 and inner stall 2 having inner finger stalls 23, and inner stall 2 is inserted into outer stall 1. FIG. 4 shows the sectional structure of the finger stall of the baseball glove according to the comparative example. As shown in FIG. 4, outer finger stall 11 of the baseball glove according to the comparative example includes projecting bonding portion 12 projecting inwardly of outer finger stalls 11, similarly to outer finger stall 11 of the baseball glove according to Embodiment 1.

As shown in FIG. 4, inner finger stall 23 is formed of front member 21 and back member 22. However, since back member 22 is formed of one member, back member 22 needs to be curved greatly to form inner finger stall 23. This leads to an increased height of inner finger stall 23. Upon insertion of inner stall 2 into outer stall 1, inner finger stall 23 of the baseball glove according to the comparative example thus deforms by being pressed by projecting bonding portion 12. Members for regulating the positional relationship between inner finger stall 23 and outer finger stall 11 are not provided in these stalls. The position of inner finger stall 23 with respect to outer finger stall 11 accordingly changes within the outer finger stall. Consequently, back member 22 of inner finger stall 23 is tilted due to the effect of projecting bonding portion 12. As a result, in the baseball glove according to the comparative example, the user of the baseball glove has difficulty in slipping the fingers into inner finger stalls 23.

In the baseball glove according to the comparative example, the deformation of inner finger stall 23 causes projecting bonding portion 12 to press the finger of the user of the baseball glove via inner finger stall 23. This causes discomfort or pain to the user of the baseball glove according to the comparative example.

In the baseball glove according to Embodiment 1, contrastingly, back member 22 of inner finger stall 23 is formed of a plurality of members, namely, lateral piece 22*a* and back piece 22*c*. In the baseball glove according to Embodiment 1, thus, the height of inner finger stall 23 is unlikely to become large. Additionally, in the baseball glove according to Embodiment 1, step 22*d* is engageable with projecting bonding portion 12. When inner stall 2 is inserted into outer stall 1, accordingly, the position of inner finger stall 23 with respect to outer finger stall 11 is less likely to change. In the baseball glove according to Embodiment 1, thus, inner finger stall 23 is less likely to be tilted due to the effect of projecting bonding portion 12, unlike in the baseball glove according to the comparative example.

Moreover, in the baseball glove according to Embodiment 1, inner finger stall 23 includes step 22*d* that is recessed inwardly at a position facing projecting bonding portion 12. In the baseball glove according to Embodiment 1, thus, inner finger stall 23 is less likely to deform in such a manner of being pressed by projecting bonding portion 12 and crushed, unlikely in the baseball glove according to the comparative example. Consequently, projecting bonding portion 12 is unlikely to press the finger of the user via inner finger stall 23.

As described above, in the baseball glove according to Embodiment 1, the user can slip the fingers into inner finger stalls 23 easily and is less likely to feel pain or discomfort.

When cutout 22*b* is provided up to the vicinity of the distal portion of inner finger stall 23, the insertion of inner finger stall 23 into outer finger stall 11 is guided by step 22*d* and projecting bonding portion 12. In such a case, thus, inner stall 2 can be inserted into outer stall 1 easily. When cutout 22*b* is provided up to a position with a distance of 50 mm from proximal portion 23*b* of inner finger stall 23, the user is less likely to feel discomfort or pain when slipping the fingers into inner finger stalls 23. Further, when cutout 22*b* is provided up to a position with a distance of 10 mm from proximal portion 23*b* of inner finger stall 23, proximal portion 23*b* of inner finger stall 23 can be prevented from losing its shape due to bonding portion 12.

Embodiment 2

Embodiment 2 will now be described with reference to the drawings. Differences from the baseball glove according to Embodiment 1 will be mainly described.

Overall Structure of Baseball Glove According to Embodiment 2

Figure 5:
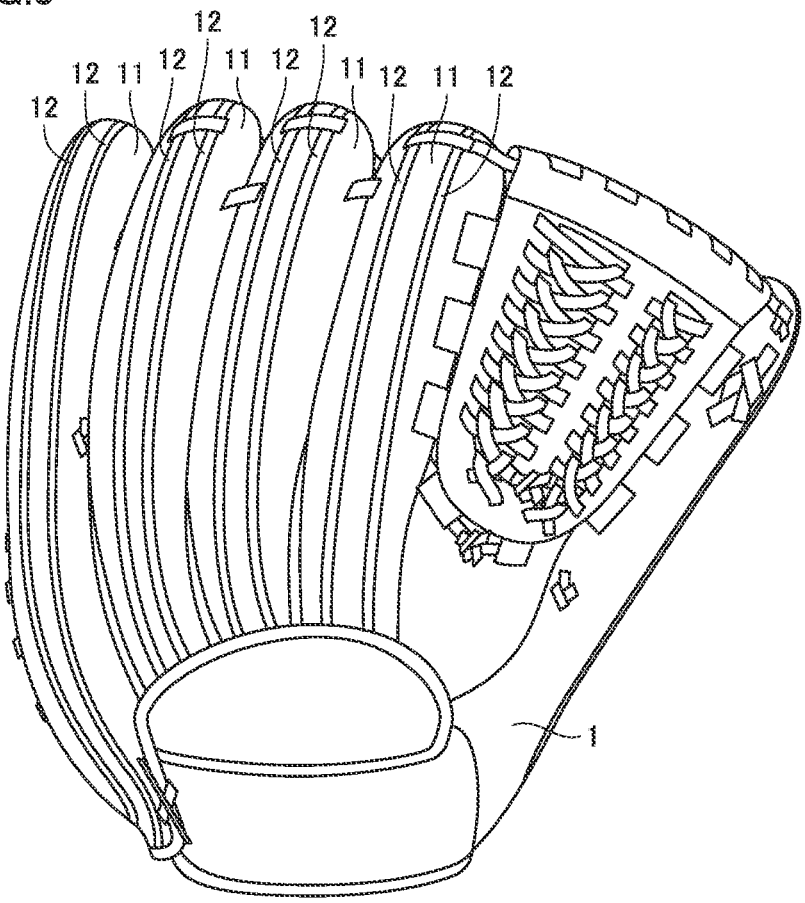
FIG. 5 shows an appearance of a baseball glove according to Embodiment 2.
Figure 6:
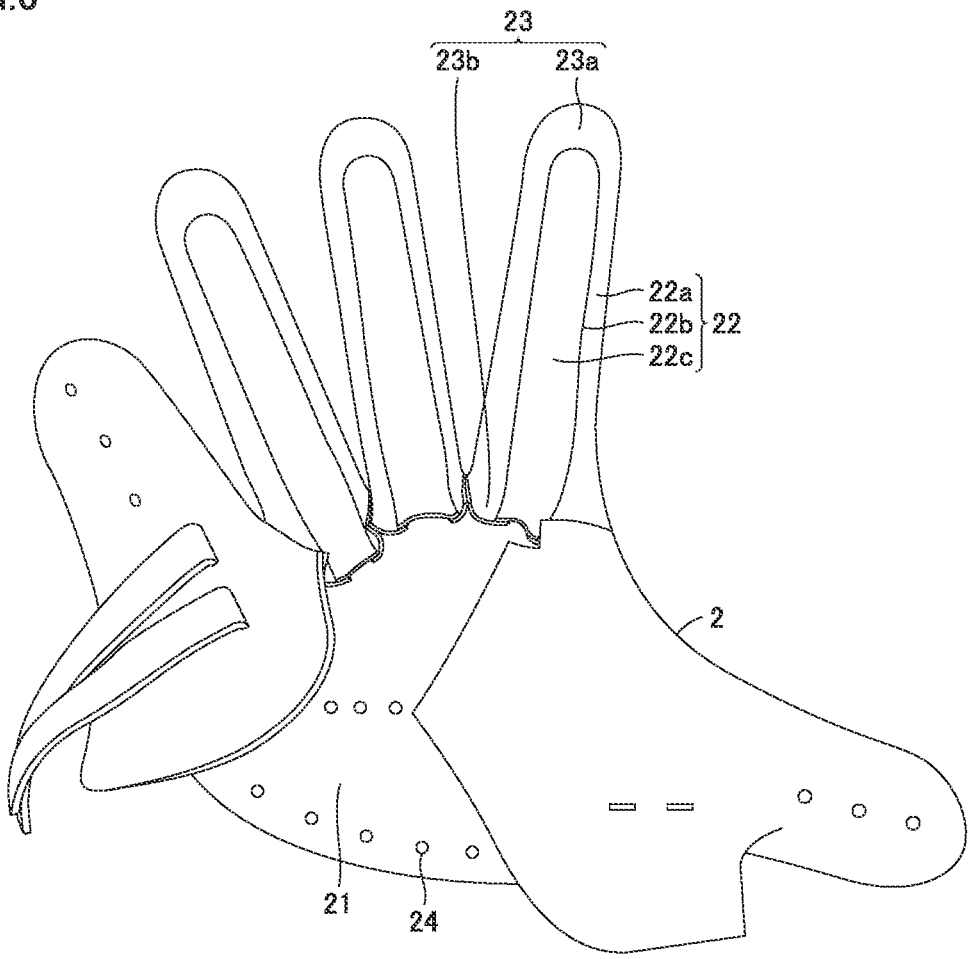
FIG. 6 shows an appearance of an inner stall of the baseball glove according to Embodiment 2.

First, the overall structure of a baseball glove according to Embodiment 2 will be described. FIG. 5 shows an appearance of the baseball glove according to Embodiment 2. FIG. 6 shows an appearance of an inner stall of the baseball glove according to Embodiment 2.

As shown in FIGS. 5 and 6, the baseball glove according to Embodiment 2 is similar to the baseball glove according to Embodiment 1 in that it includes outer stall 1 and inner stall 2, outer stall 1 includes outer finger stalls 11, and inner stall 2 includes inner finger stalls 23.

Figure 7:
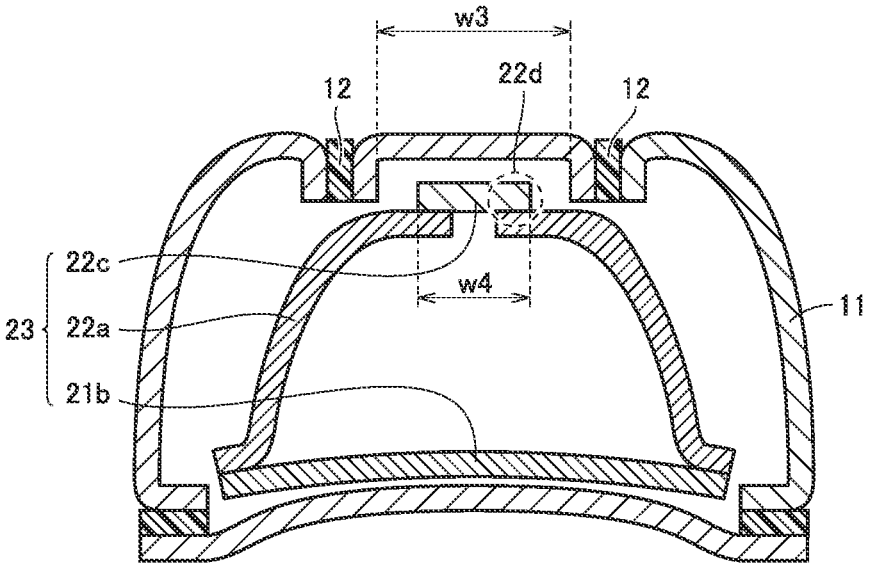
FIG. 7 is a sectional view of a finger stall portion of the baseball glove according to Embodiment 2.

The baseball glove according to Embodiment 2, however, differs from the baseball glove according to Embodiment 1 in that projecting bonding portions 12 formed on the finger nail side of outer finger stall 11 are formed at two locations for one outer finger stall 11. As shown in FIG. 7, the baseball glove according to Embodiment 2 also differs from the baseball glove according to Embodiment 1 in that back piece 22*c* is bonded to the outer side of lateral piece 22*a* and that step 22*d* has a sectional shape extending from the center toward the lateral side of inner finger stall 23 in the width direction on the finger nail side so as to be closer to finger portion 21*b* at the lateral side.

Structure of Finger Stall of Baseball Glove According to Embodiment 2

Next, a detailed structure of the finger stall of the baseball glove according to Embodiment 2 will be described. FIG. 7 shows the sectional structure of the finger stall of the baseball glove according to Embodiment 2. As shown in FIG. 7, projecting bonding portions 12 are formed at two locations on the finger nail side of outer finger stall 11 in Embodiment 2, unlike in Embodiment 1.

As shown in FIG. 7, steps 22*d* are arranged at position facing projecting bonding portions 12. In Embodiment 2, steps 22*d* are raised so as to have an end surface facing the lateral surface of inner finger stall 23, unlike in Embodiment 1. Also, steps 22*d* are arranged between projecting bonding portions 12 at two locations. This allows inner finger stall 23 and outer finger stall 11 to be engaged with each other. A distance W3 between two projecting bonding portions 12 of FIG. 7 may be substantially equal to a width W4 of back piece 22*c* (or, also referred to as the distance between steps 22*d* located at opposite ends of back piece 22*c*), or may be greater than width W4.

Figure 8:
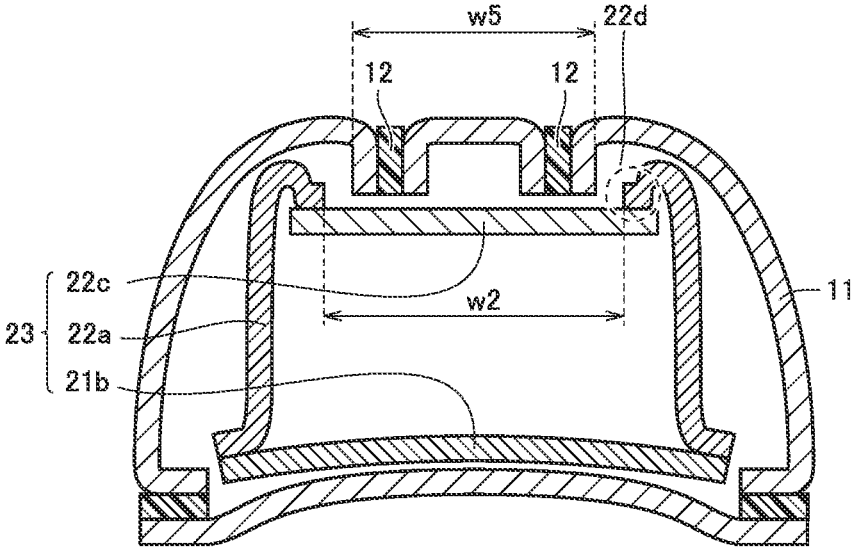
FIG. 8 is a sectional view of a finger stall portion of a baseball glove according to a modification of Embodiment 2.

As shown in FIG. 8, back piece 22*c* may be bonded to the inner side of lateral piece 22*a* to form steps 22*d* in such a manner of being recessed inwardly of inner finger stall 23, and the width of back piece 22*c* may be made greater than the interval between projecting bonding portions 12 formed at two locations. From a different perspective, in the direction perpendicular to the direction in which outer finger stall 11 extends, engagement width W2 that is the distance between steps 22*d* located at opposite ends of back piece 22*c* may be substantially equal to a distance W5 between the peripheral lateral surfaces of two projecting bonding portions 12, or may be greater than width W5. This allows outer finger stall 11 and inner finger stall 23 to be engaged with each other so as to sandwich projecting bonding portion 12 between two steps 22*d*.

Effects of Baseball Glove According to Embodiment 2

The effects of the baseball glove according to Embodiment 2 will be described below.

In the baseball glove according to Embodiment 2, inner finger stall 23 is formed of a plurality of members, namely, lateral piece 22*a* and back piece 22*c*, which does not increase the height of inner finger stall 23. Also, since projecting bonding portion 12 of outer finger stall 11 is engageable with step 22*d* of inner finger stall 23, the positions of outer finger stall 11 and inner finger stall 23 are unlikely to change with respect to each other. Further, since projecting bonding portion 12 and step 22*d* are located at positions facing each other, inner finger stall 23 is not pressed by projecting bonding portion 12, and accordingly, is less likely to deform. Thus, projecting bonding portion 12 is less likely to press the finger of the user via inner finger stall 23. Consequently, the user can slip the fingers into inner finger stalls 23 easily and is less likely to feel pain or discomfort also in Embodiment 2.

It should be construed that the embodiments disclosed herein are given by way of illustration in all respects, not by way of limitation. It is therefore intended that the scope of the present invention is defined by claims, not only by the embodiments described above, and encompasses all modifications and variations equivalent in meaning and scope to the claims.

REFERENCE SIGNS LIST

1 outer stall, 11 outer finger stall, 12 projecting bonding portion, 2 inner stall, 21 front member, 22 back member, 22*a* lateral piece, 22*b* cutout, 22*c* back piece, 22*d* step, 23 inner finger stall, 23*a* distal portion, 23*b* proximal portion, 24 inner stall through-hole.

The invention claimed is:

1. A catching tool for baseball, comprising:

the catching tool having a fingernail side opposite a catching side, an inner stall including an inner finger stall having a distal portion and a proximal portion, and having a front member corresponding to the catching side of the inner stall and a back member corresponding to the fingernail side; and an outer stall including an outer finger stall, the outer finger stall including at least one projecting bonding portion projecting inwardly, the at least one projecting bonding portion being formed at a center portion of the fingernail side of the outer finger stall, the inner finger stall including a lateral piece having a cutout formed from the proximal portion toward the distal portion, and a back piece bonded to the lateral piece so as to cover the cutout, the lateral piece having a first inner surface facing inside of the inner finger stall and a first outer surface opposite to the first inner surface, the back piece having a second inner surface facing inside of the inner finger stall and a second outer surface opposite to the second inner surface, the inner finger stall having a step constituted by the first outer surface and the second outer surface and formed by bonding the first inner surface to the second outer surface at a position facing the at least one projecting bonding portion, the step being engageable with the at least one projecting bonding portion.

2. The catching tool for baseball according to claim 1, wherein a number of the at least one projecting bonding portion is one per outer finger stall, and the back piece is bonded to an inner side of the lateral piece.

3. The catching tool for baseball according to claim 1, wherein the back piece is softer than the lateral piece.

4. The catching tool for baseball according to claim 1, wherein the cutout is formed up to the distal portion.

5. The catching tool for baseball according to claim 1, wherein the cutout is formed up to a position 50 mm from the proximal portion.

6. The catching tool for baseball according to claim 1, wherein the cutout is formed up to a position 10 mm from the proximal portion.

7. The catching tool for baseball according to claim 1, wherein the lateral piece has a first portion extending toward the fingernail side of the outer finger stall and a second portion in which the lateral piece changes direction to bend from the fingernail side of the outer finger stall toward a center of the outer finger stall.

8. The catching tool for baseball according to claim 1, wherein the lateral piece is a first lateral piece and the step is a first step located proximate a first end of the back piece, the catching tool for baseball further comprising:

a second lateral piece forming a second step with the back piece; and an engagement width defined as a distance between the first step and the second step, the engagement width being approximately equal to a width of the at least one projecting bonding portion.

* * * * *